US008614401B2

(12) United States Patent
Tseng

(10) Patent No.: US 8,614,401 B2
(45) Date of Patent: Dec. 24, 2013

(54) KEYSWITCH AND KEYBOARD

(75) Inventor: Yang-Shu Tseng, Taoyuan (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 185 days.

(21) Appl. No.: 13/236,664

(22) Filed: Sep. 20, 2011

(65) Prior Publication Data

US 2012/0073942 A1 Mar. 29, 2012

(30) Foreign Application Priority Data

Sep. 28, 2010 (TW) ..... 99218701 U

(51) Int. Cl.
*H01H 9/26* (2006.01)
*H01H 13/72* (2006.01)
*H01H 13/76* (2006.01)

(52) U.S. Cl.
USPC ..... 200/5 A

(58) Field of Classification Search
USPC ..... 200/517, 5 R, 5 A, 5 B, 344, 329, 337, 200/341, 345, 314, 408, 443, 510–513, 516, 200/520
See application file for complete search history.

(56) References Cited

U.S. PATENT DOCUMENTS

| | | | | |
|---|---|---|---|---|
| 4,668,843 | A * | 5/1987 | Watanabe et al. | 200/5 A |
| 5,747,756 | A * | 5/1998 | Boedecker | 200/5 A |
| 6,765,158 | B1 * | 7/2004 | Morrison et al. | 200/5 R |
| 7,902,474 | B2 * | 3/2011 | Mittleman et al. | 200/516 |
| 2002/0079211 | A1 * | 6/2002 | Katayama et al. | 200/517 |
| 2011/0272262 | A1 * | 11/2011 | Chen | 200/5 A |

* cited by examiner

*Primary Examiner* — Edwin A. Leon
*Assistant Examiner* — Anthony R. Jimenez
(74) *Attorney, Agent, or Firm* — Winston Hsu; Scott Margo

(57) ABSTRACT

A keyswitch includes a base, a circuit board, a resilient support member and a key cap. The circuit board is disposed on the base and has a switch. The resilient support member is disposed on the circuit board. The resilient support member includes a trigger portion, a resilient portion and a support portion, wherein the resilient portion connects the trigger portion and the support portion, and the trigger portion faces the switch on the circuit board. The key cap is disposed on the resilient support member. The support portion of the resilient support member supports the key cap over the base. When the key cap is pressed, the trigger portion of the resilient support member triggers the switch and the resilient portion provides an elastic force for the key cap.

14 Claims, 4 Drawing Sheets

KEYSWITCH AND KEYBOARD

BACKGROUND OF THE INVENTION

1. Field of the Invention

The invention relates to a keyswitch and a keyboard and, more particularly, to a keyswitch adapted to a slim keyboard.

2. Description of the Prior Art

A keyboard, which is the most common input device, can be found in variety of electronic equipments for users to input characters, symbols, numerals and so on. From consumer electronic products to industrial machine tools are all equipped with a keyboard for purpose of operation.

Referring to FIG. 1, FIG. 1 is a cross-sectional view illustrating a keyswitch 1 of the prior art. As shown in FIG. 1, the keyswitch 1 comprises a base 10, a key cap 12, a circuit board 14, a lift support device 16 and a resilient member 18. The circuit board 14 is disposed on the base 10. The lift support device 16 is disposed between the key cap 12 and the base 10 and used for supporting the key cap 12. The resilient member 18 is also disposed between the key cap 12 and the base 10. When the key cap 12 is pressed by a user, the resilient member provides an elastic force for the key cap 12 so as to make the key cap 12 return to the original position.

As shown in FIG. 1, the key cap 12 has a first sliding groove 120 and a first engaging groove 122, the base 10 has a second sliding groove 100 and a second engaging groove 102, and the lift support device 16 comprises a first support member 160 and a second support member 162. One end of the first support member 160 is slidably disposed in the first sliding groove 120 and the other end of the first support member 160 is pivotally disposed in the second engaging groove 102. One end of the second support member 162 is slidably disposed in the second sliding groove 100 and the other end of the second support member 162 is pivotally disposed in the first engaging groove 122. Accordingly, the key cap 12 can move toward the base 10 along with the lift support device 16. However, the aforesaid mechanism of the conventional lift support device 16 will increase height of the keyswitch 1, such that the conventional keyswitch 1 cannot be adapted to a slim keyboard.

SUMMARY OF THE INVENTION

Therefore, an objective of the invention is to provide a keyswitch, which is adapted to a slim keyboard.

According to an embodiment, a keyswitch of the invention comprises a base, a circuit board, a resilient support member and a key cap. The circuit board is disposed on the base and has a switch. The resilient support member is disposed on the circuit board. The resilient support member comprises a trigger portion, a resilient portion and a support portion, wherein the resilient portion connects the trigger portion and the support portion, and the trigger portion faces the switch. The key cap is disposed on the resilient support member. The support portion of the resilient support member supports the key cap over the base. When the key cap is pressed, the trigger portion of the resilient support member triggers the switch and the resilient portion provides an elastic force for the key cap. When the external force is released from the key cap, the elastic force provided by the resilient portion can make the key cap return to the original position.

Another objective of the invention is to provide a keyboard, which comprises a base, a circuit board and a plurality of keyswitches disposed on the base. The structure of one of the keyswitches of the keyboard is mentioned in the above.

As mentioned in the above, the invention utilizes the support portion of the resilient support member to support the key cap and utilizes the resilient portion of the resilient support member to provide the elastic force for the key cap. In other words, the invention replaces the conventional lift support device by the resilient support member so as to reduce the volume of the keyswitch and keyboard. Accordingly, the keyswitch of the invention can be adapted to a slim keyboard.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
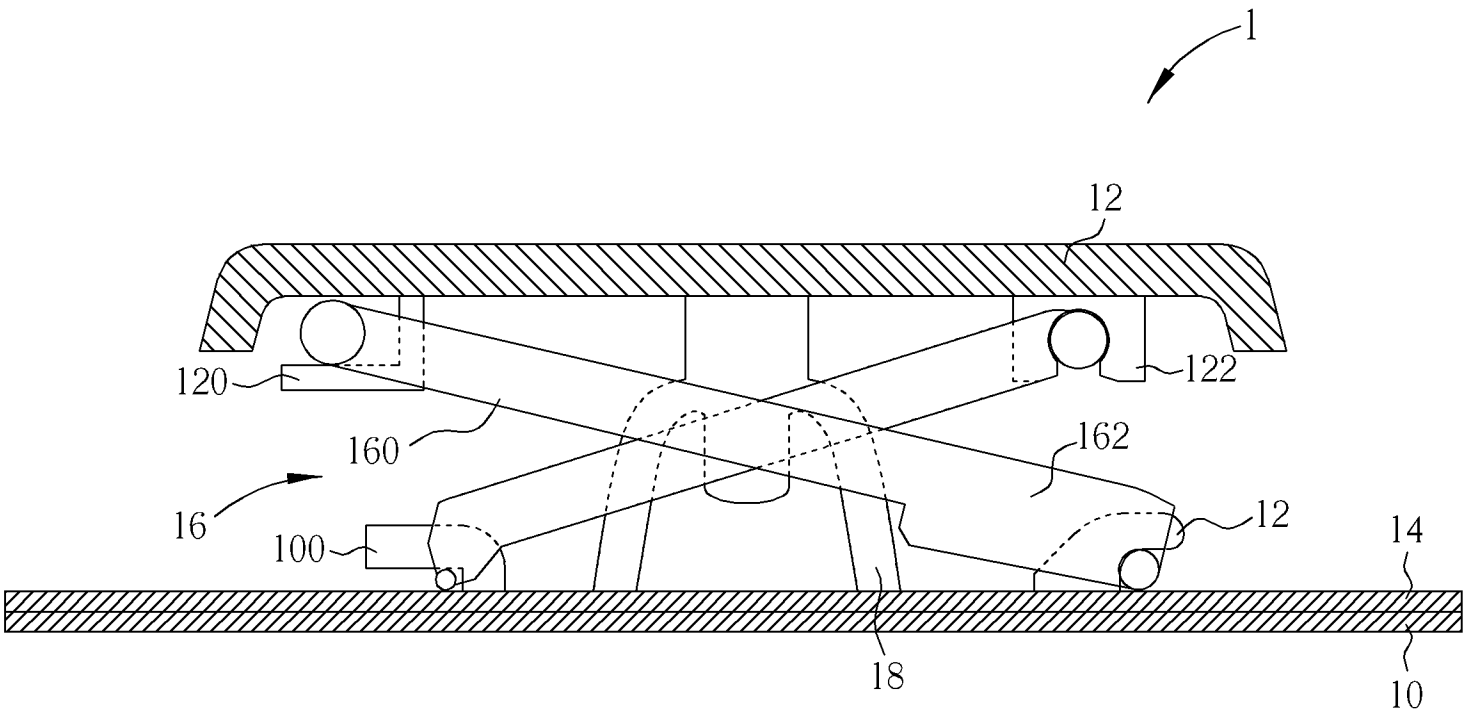
FIG. 1 PRIOR ART
FIG. 1 is a cross-sectional view illustrating a keyswitch of the prior art.
Figure 2:
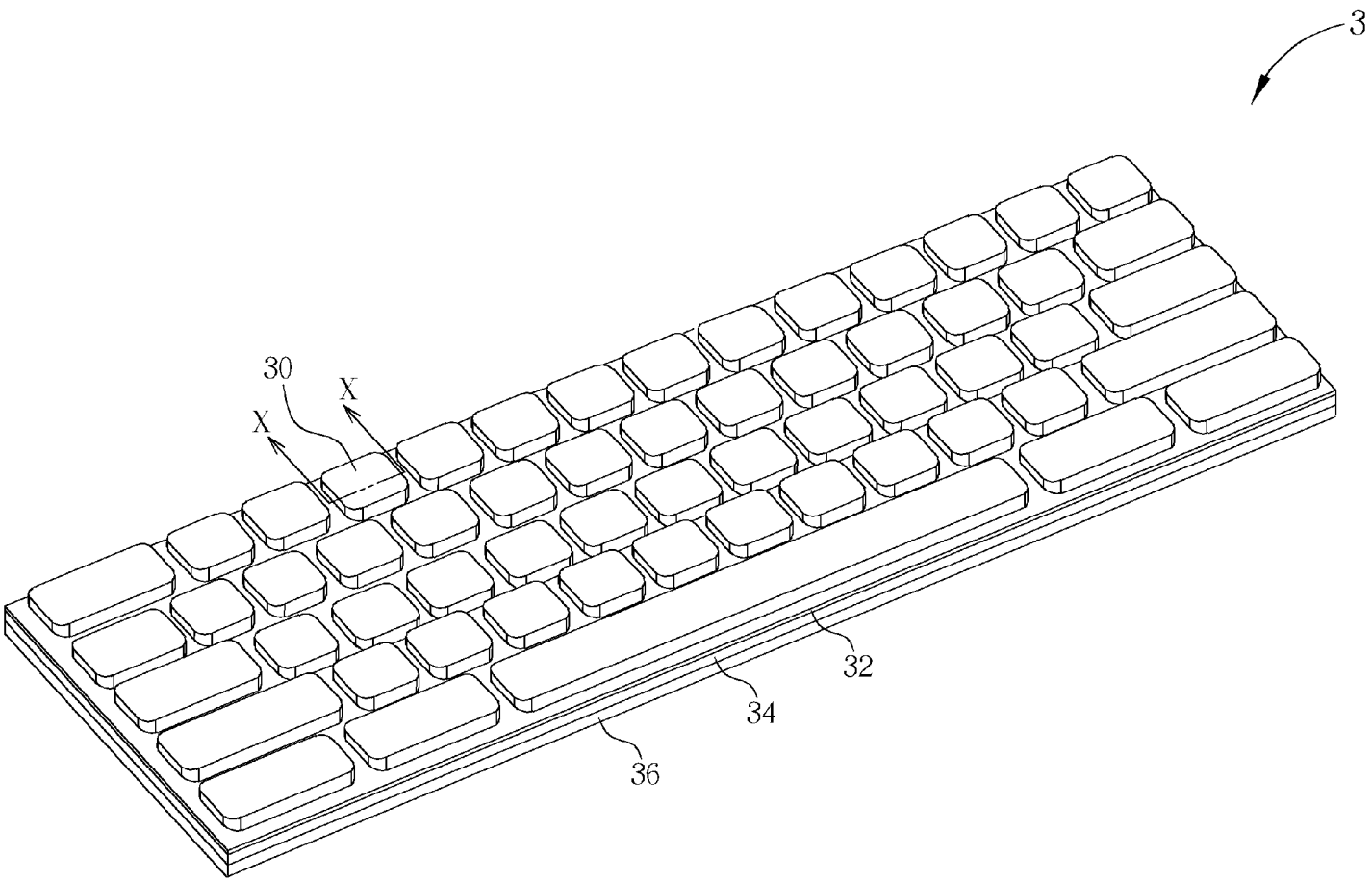
FIG. 2 is a schematic diagram illustrating a keyboard according to an embodiment of the invention.

Referring to FIG. 2, FIG. 2 is a schematic diagram illustrating a keyboard 3 according to an embodiment of the invention. As shown in FIG. 2, the keyboard 3 comprises a plurality of keyswitches 30, a film 32, a circuit board 34 and a base 36. The keyswitches 30, the film 32 and the circuit board 34 are disposed on the base 36. The keyswitches 30 are used for a user to press so as to execute desired function correspondingly. In this embodiment, the keyboard 3 may be, but not limited to, a slim keyboard and the keyswitches 30 may be, but not limited to, slim keyswitches.

Figure 3:
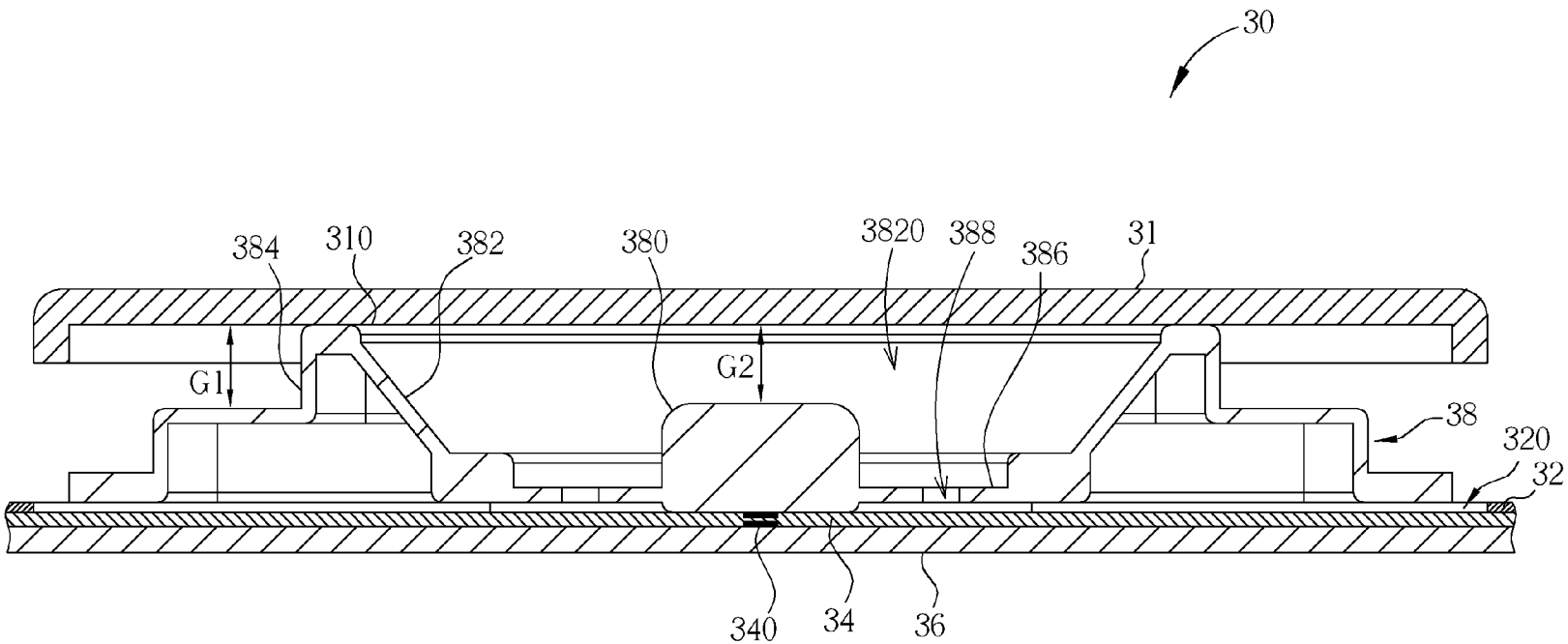
FIG. 3 is a cross-sectional view illustrating one of the keyswitches shown in FIG. 2 along line X-X.
Figure 4:
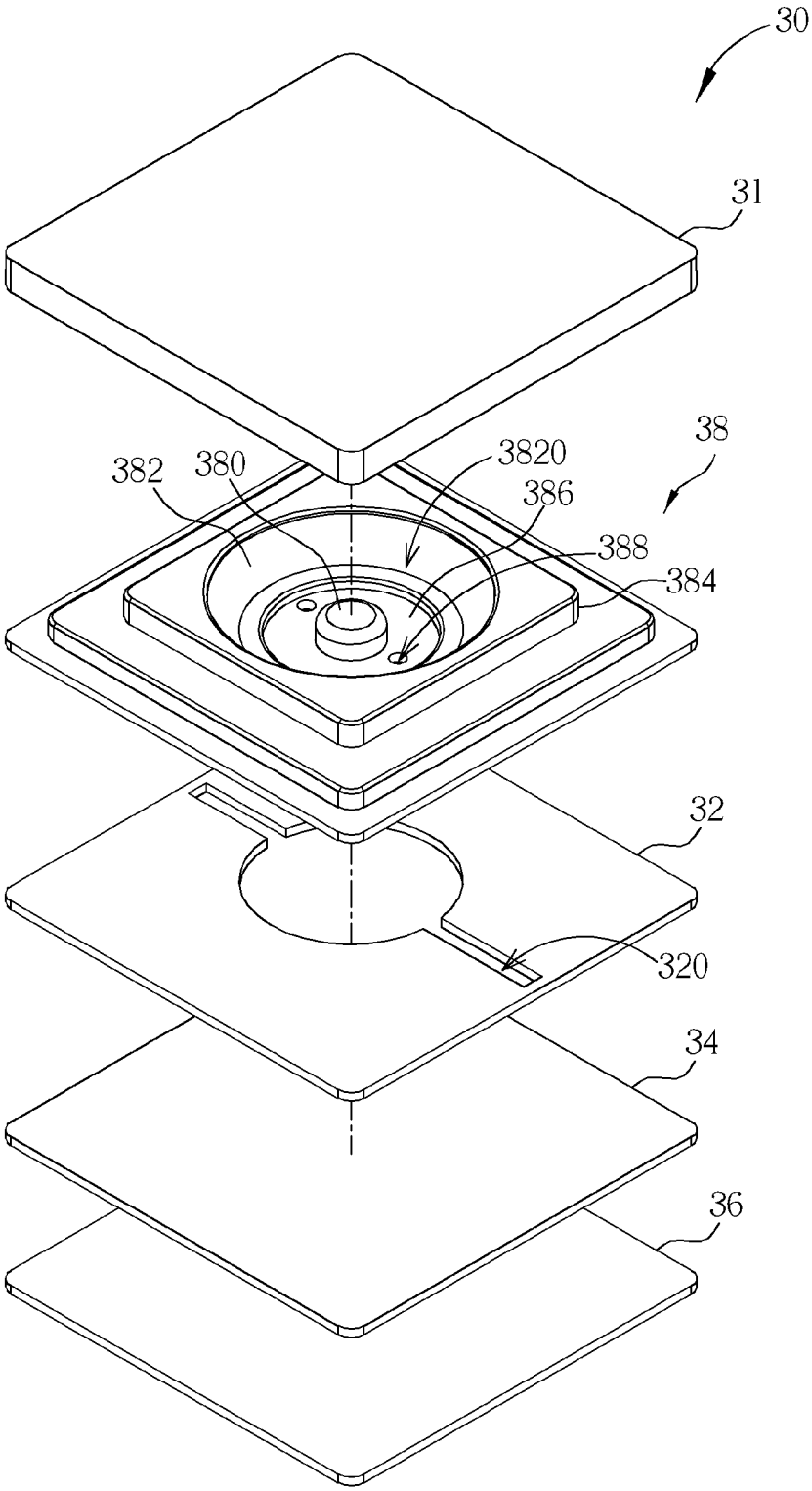
FIG. 4 is an exploded view illustrating the keyswitch shown in FIG. 3.

Referring to FIGS. 3 and 4, FIG. 3 is a cross-sectional view illustrating one of the keyswitches 30 shown in FIG. 2 along line X-X, and FIG. 4 is an exploded view illustrating the keyswitch 30 shown in FIG. 3. As shown in FIGS. 3 and 4, the keyswitch 30 comprises a key cap 31, a film 32, a circuit board 34, a base 36 and a resilient support member 38. The circuit board 34 is disposed on the base 36 and has a switch 340. The resilient support member 38 is disposed on the circuit board 34. In this embodiment, the film 32 is disposed between the resilient support member 38 and the circuit board 34 and used for fixing the resilient support member 38. The key cap 31 is disposed on the resilient support member 38. In this embodiment, the resilient support member 38 may be made of, but not limited to, rubber and the circuit board 34 maybe, but not limited to, a membrane circuit board.

The resilient support member 38 comprises a trigger portion 380, a resilient portion 382 and a support portion 384. The resilient portion 382 connects the trigger portion 380 and the support portion 384 and the trigger portion 380 faces the switch 340 of the circuit board 34. In this embodiment, the resilient portion 382 comprises a bowl-shaped recess 3820, wherein the support portion 384 surrounds the bowl-shaped recess 3820 and the trigger portion 380 is located at a center of the bowl-shaped recess 3820. The bowl-shaped recess 3820 sinks toward the base 36 with respect to the key cap 31, as shown in FIG. 3. The support portion 384 supports the key cap 31 over the base 36. When the key cap 31 is pressed, the resilient portion 382 deforms elastically so as to drive the trigger portion 380 to move toward the base 36 and then trigger the switch 340 of the circuit board 34. At this time, the resilient portion 382 provides an elastic force for the key cap 31. When the external force is released from the key cap 31, the elastic force provided by the resilient portion 382 can make the key cap 31 return to the original position.

As shown in FIG. 3, a first gap G1 is between a bottom 310 of the key cap 31 and the support portion 384 of the resilient support member 38. When the key cap 31 is pressed, the resilient portion 382 can deform within the first gap G1. Furthermore, a second gap G2 is between the bottom 310 of the key cap 31 and the trigger portion 380 of the resilient support member 38. When the key cap 31 is pressed, the second gap G2 can provide a stroke feeling for the user.

As shown in FIGS. 3 and 4, the support portion 384 of the resilient support member 38 is designed as step-shaped so as to support the key cap 31 well. In other embodiments of the invention, the support portion 384 of the resilient support member 38 maybe designed as arc-shaped or strip-shaped according to practical applications. In other words, the shape of the support portion 384 of the resilient support member 38 is not limited to step-shaped as long as the support portion 384 of the resilient support member 38 can support the key cap 31 well.

In this embodiment, two first exhaust holes 388 are formed on a bottom 386 of the resilient support member 38 and two second exhaust holes 320 are formed on the film 32. When the key cap 31 is pressed, air between the key cap 31 and the resilient support member 38 is exhausted through the first and second exhaust holes 388, 320, so as to prevent the air between the key cap 31 and the resilient support member 38 from generating resistance while the user presses the key cap 31.

It should be noted that the resilient support member 38 may be formed independently or be formed with the key cap 31 integrally. If the resilient support member 38 is formed independently, the key cap 31 can be aligned with the resilient support member 38 using assembling tool and then the keycap 31 can be adhered to the resilient support member 38 using adhesive. On the other hand, the key cap 31 and the resilient support member 38 of the invention can be formed integrally by double injection molding or in-mold injection molding.

Compared to the prior art, the invention utilizes the support portion of the resilient support member to support the key cap and utilizes the resilient portion of the resilient support member to provide the elastic force for the key cap. In other words, the invention replaces the conventional lift support device by the resilient support member so as to reduce the volume of the keyswitch and keyboard. Accordingly, the keyswitch of the invention can be adapted to a slim keyboard.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a base;

a circuit board disposed on the base, the circuit board having a switch;

a resilient support member disposed on the circuit board, a first exhaust hole is formed on a bottom of the resilient support member, the resilient support member comprising a trigger portion, a resilient portion and a support portion, the resilient portion connecting the trigger portion and the support portion, the trigger portion facing the switch;

a film disposed between the resilient support member and the circuit board, a second exhaust hole being formed on the film; and a key cap disposed on the resilient support member;

wherein the support portion supports the key cap over the base, when the key cap is pressed, the trigger portion triggers the switch and the resilient portion provides an elastic force for the key cap, and air between the key cap and the resilient support member is exhausted through the first exhaust hole and the second exhaust hole.

2. The keyswitch of claim 1, wherein the key cap and the resilient support member are formed integrally.

3. The keyswitch of claim 1, wherein a shape of the support portion is one selected from a group consisting of step-shaped, arc-shaped and strip-shaped.

4. The keyswitch of claim 1, wherein a first gap is between a bottom of the key cap and the support portion.

5. The keyswitch of claim 1, wherein a second gap is between a bottom of the key cap and the trigger portion.

6. The keyswitch of claim 1, wherein the circuit board is a membrane circuit board.

7. The keyswitch of claim 1, wherein the resilient portion comprises a bowl-shaped recess, the support portion surrounds the bowl-shaped recess, the support portion supports the key cap over the base, the trigger portion is located at a center of the bowl-shaped recess, and the bowl-shaped recess sinks toward the base with respect to the key cap.

8. A keyboard comprising:

a base;

a circuit board disposed on the base, the circuit board having a switch; and a plurality of keyswitches, one of the keyswitches comprising:

a resilient support member disposed on the circuit board, a first exhaust hole is formed on a bottom of the resilient support member, the resilient support member comprising a trigger portion, a resilient portion and a support portion, the resilient portion connecting the trigger portion and the support portion, the trigger portion facing the switch;

a film disposed between the resilient support member and the circuit board, a second exhaust hole being formed on the film; and a key cap disposed on the resilient support member;

wherein the support portion supports the key cap over the base, when the key cap is pressed, the trigger portion triggers the switch and the resilient portion provides an elastic force for the key cap, and air between the key cap and the resilient support member is exhausted through the first exhaust hole and the second exhaust hole.

9. The keyboard of claim 8, wherein the key cap and the resilient support member are formed integrally.

10. The keyboard of claim 8, wherein a shape of the support portion is one selected from a group consisting of step-shaped, arc-shaped and strip-shaped.

11. The keyboard of claim 8, wherein a first gap is between a bottom of the key cap and the support portion.

12. The keyboard of claim 8, wherein a second gap is between a bottom of the key cap and the trigger portion.

13. The keyboard of claim 8, wherein the circuit board is a membrane circuit board.

14. The keyboard of claim 8, wherein the resilient portion comprises a bowl-shaped recess, the support portion surrounds the bowl-shaped recess, the support portion supports the key cap over the base, the trigger portion is located at a center of the bowl-shaped recess, and the bowl-shaped recess sinks toward the base with respect to the key cap.

* * * * *